United States Patent [19]

Conforti et al.

[11] 4,414,612

[45] Nov. 8, 1983

[54] HAND-HELD LIGHT WITH MEANS FOR CONTROLLING BEAM WIDTH

[75] Inventors: Frederick J. Conforti, Aurora; Kenneth R. Fenne, Glen Ellyn, both of Ill.

[73] Assignee: Pittway Corporation, Aurora, Ill.

[21] Appl. No.: 460,176

[22] Filed: Jan. 24, 1983

[51] Int. Cl.[3] ..... F21L 7/00

[52] U.S. Cl. ..... 362/188; 362/186; 362/200; 362/202; 362/205; 362/199; 362/269; 362/285; 362/362; 362/427

[58] Field of Search ..... 362/188, 186, 200, 202, 362/205, 199, 269, 285, 362, 427

[56] References Cited

U.S. PATENT DOCUMENTS

| | | | |
|---|---|---|---|
| 2,107,599 | 2/1938 | Yu | 362/188 |
| 2,125,038 | 7/1938 | Tompkins et al. | 362/188 |
| 3,689,759 | 9/1972 | Dill | 362/188 |

*Primary Examiner*—Stephen J. Lechert, Jr.

*Attorney, Agent, or Firm*—Dithmar, Stotland, Stratman & Levy

[57] ABSTRACT

A flashlight has a battery housing and a head. A carriage is slidably mounted on opposing walls of the head. The carriage carries a socket for holding a flashlight bulb. A tab on the carriage is accessible to one's finger to enable movement of the carriage and the bulb carried thereby in any one of a number of positions, thereby to control the beam width.

20 Claims, 7 Drawing Figures

HAND-HELD LIGHT WITH MEANS FOR CONTROLLING BEAM WIDTH

BACKGROUND OF THE INVENTION

A desirable feature of certain hand-held lights, such as battery operated flashlights, is the capability of adjusting the beam width. In certain instances, it is useful to provide a concentrated beam of light of constant diameter, while in other instances, it is desirable for the beam to spread and thereby illuminate a large area. This has been achieved in the past by selecting the position of the bulb with respect to the parabolic reflector commonly used in flashlights. A bulb is located at the focus of a parabolic reflector and rays from the bulb are collimated by the reflector to provide a beam which is of substantially constant diameter. In the past, a beam that is conical in shape, that is, one that spreads, has been achieved by moving the bulb so as not to be located at the focus of the reflector. The distance between the bulb location and the focus will affect the amount of beam spread. Flashlights that have had this capability in the past have been too expensive to manufacture to be saleable in the mass market. Also, prior flashlights with adjustable beam width incorporate a head fixed with respect to the main body, which is undesirable in certain instances. U.S. Pat. Nos. 1,991,753 to Kurlander and 1,674,650 to Leser disclose such prior flashlights.

SUMMARY OF THE INVENTION

It is therefore an important object of the present invention to provide an improved hand-held light having capability of beam width adjustment.

Another object in connection with the foregoing is to provide such a hand-held light which is sufficiently economical to make to appeal to the mass market.

Another object is to provide a hand-held light which has capability of adjusting its beam width and also the orientation of the head.

In summary there is provided a hand-held light comprising a head having a wall, a carriage slidably mounted on the wall and slidable between first and second extremes, a socket on the carriage for holding a bulb, and means on the carriage accessible on the exterior of the head for being engaged by one's finger to move the carriage to a selected position between the first and second extremes.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
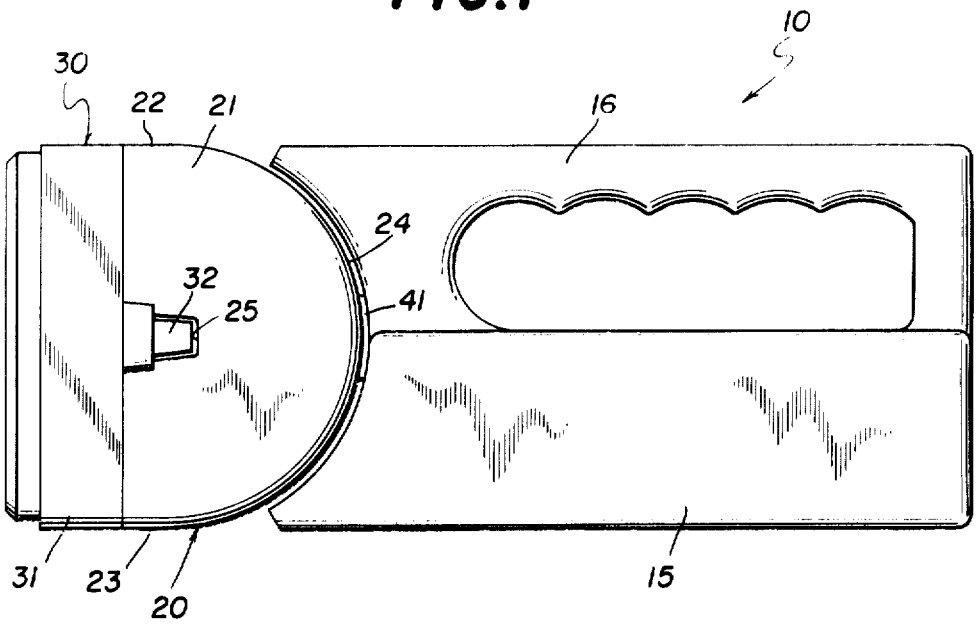
FIG. 1 is a side elevational view of a battery operated flashlight incorporating the features of the present invention.
Figure 2:
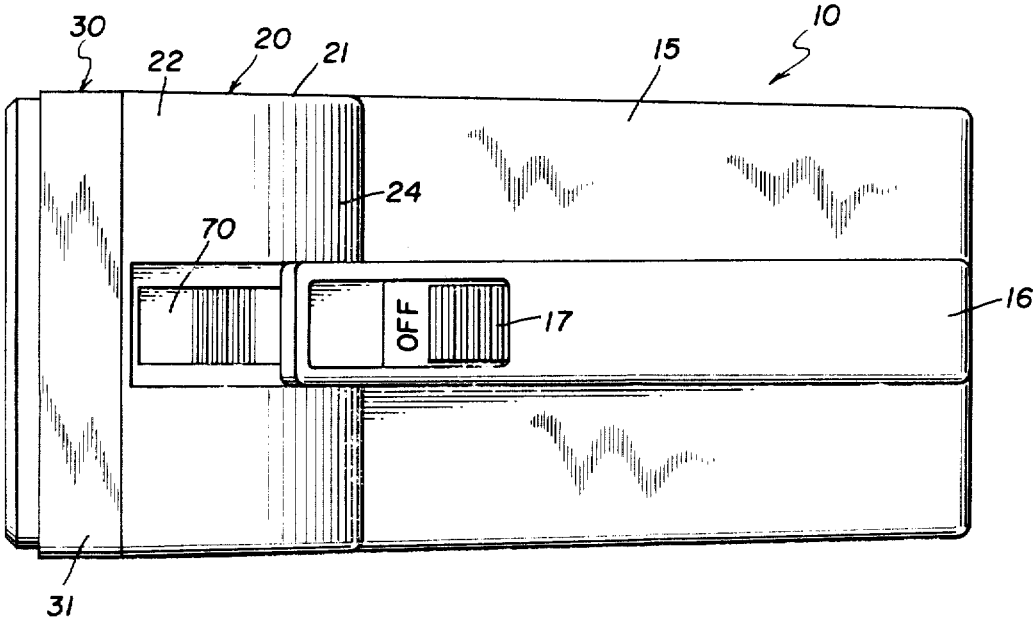
FIG. 2 is a top plan view of the flashlight.

Turning now to the drawings and more particularly to FIGS. 1 and 2 thereof, there is depicted a flashlight constructed in accordance with the present invention, the flashlight being generally designated by the numeral 10. The flashlight 10 includes a housing 15 carrying an upstanding handle 16. The housing 15 contains a battery, which preferably is rechargeable, together with a power supply and other electronics for recharging of the battery and the like. Preferably the housing 15 and the handle 16 are molded of plastic in two parts and held together by screws or the like. The housing 15 is generally rectangular and is elongated front to back, the front being toward the left as viewed in FIG. 1 and the back being toward the right. The front of the handle 16 and the front of the housing 15 are part cylindrical to accommodate a head 20. An on-off switch 17 is located in the handle at its front. The switch is moved forwardly to turn on the flashlight and rearwardly to turn it off. One can operate the on-off switch 17 with one's thumb while his hand is grasping the handle 16.

The head 20 is preferably of one-piece plastic construction having a pair of laterally spaced-apart side walls 21, a top wall 22, a bottom wall 23 and a part cylindrical rear wall 24 that merges into and is a continuation of the top and bottom walls 22 and 23. The curvature of the rear wall 24 matches the curvature of the front of the handle 16 and the housing 15 to accommodate tilting movement of the head 20 with respect to the housing 15. Each of the side walls 21 has a keeper in the form of an opening 25 at the front thereof.

The flashlight 10 further comprises a cover assembly 30 including a generally rectangular bezel 31. Fingers 32 extend rearwardly from the side walls of the bezel 31 and engage in the openings 25.

Figure 3:
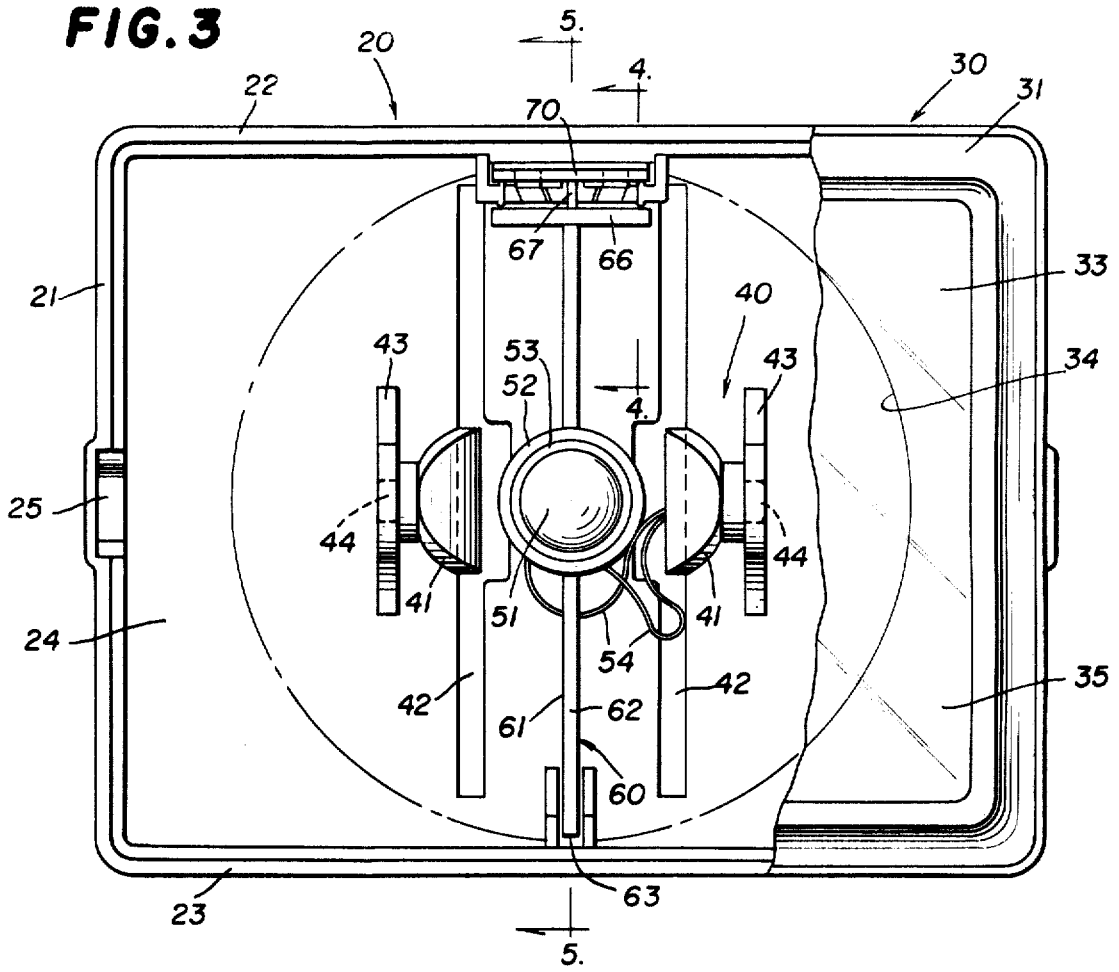
FIG. 3 is a front elevational view of the flashlight on an enlarged scale, with most of the cover assembly broken away to expose the interior of the head.

Turning now to FIG. 3, the cover assembly 30 includes a lens 33 which serves to focus the light. A parabolic reflector 34 is also included in the cover assembly 30, a planar extension 35 of such reflector being located behind the lens 33. The lens 33 and the reflector 34 are preferably permanently attached to the bezel 31. Only a fragmentary portion of the reflector 34 is depicted but it is to be understood that centrally thereof is an opening to receive the socket and bulb carried thereby.

Mounting structure 40 is provided to swivelly attach the head 20 to the housing 15. Protruding forwardly from the front of the housing 15 are two laterally spaced-apart, forwardly extending legs 41 which respectively extend through two spaced-apart slits 42 in the rear wall 24 of the head 20. The thickness of the legs 41 is less than the width of the slits 42. The legs 41 have outwardly curved outer ends, that is, they are curved toward the side walls 21. The mounting structure 40 further includes a pair of legs 43 integral with the rear wall 24 and extending forwardly therefrom. The outer ends of the legs 41 are spring biased against the legs 43. The legs 43 respectively carry pins 44 which extend into holes respectively in the legs 41. Thus the pins 44 define an axis about which the head 20 swivels with respect to the housing 15. The capability of the head 20 being oriented as desired to direct the beam of light is not directly part of this invention. However, further details thereof may be had by referring to copending application Ser. No. 460,590, filed Jan. 24, 1983, entitled Hand-Held Light with Swivel Head.

Figure 5:
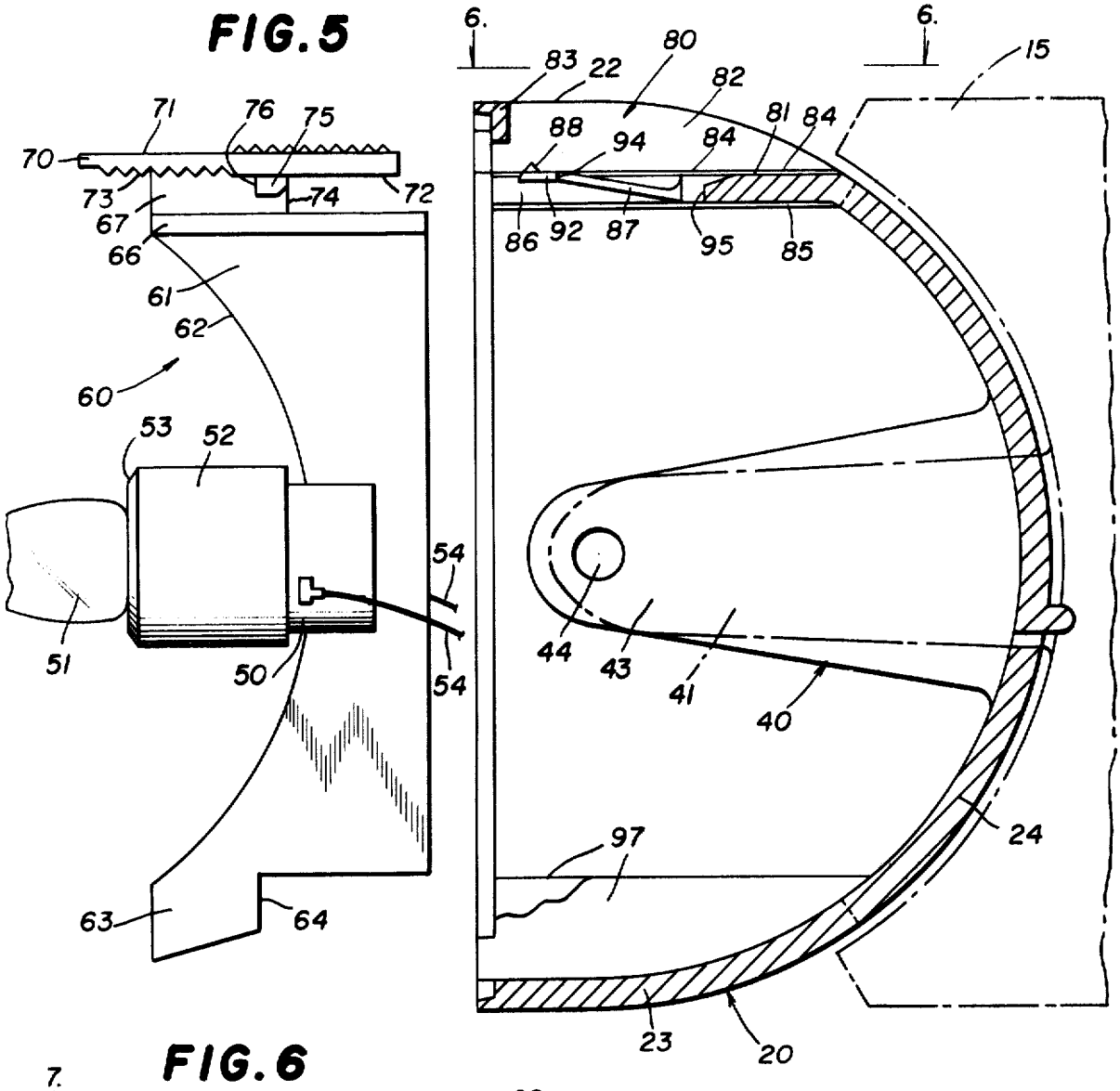
FIG. 5 is a view in vertical section taken along the line 5—5 of FIG. 3, but with the carriage shown separated from the head.

A socket 50 (FIG. 5) carries a bulb 51 which protrudes through the central opening in the reflector 34. The socket 50 is basically formed of plastic although it has the usual metallic elements. A sleeve 52 is slipped onto the socket 50 and has a rim 53 which retains the bulb 51 in place. Wires 54 are attached to the socket, are taped to one of the legs 41 and extend through the associated slit 42 into the housing 15 for connection to the battery and circuitry therein. The plastic socket 50 is integral with a carriage 60. Details of the carriage 60 are best seen in FIG. 5. The carriage 60 includes an elongated plate-like member 61 which has a concave front edge 62. The socket 50 is located at the deepest point on such edge. The member 61 has a lower end 63, the rear portion of which is cut out at 64 for reasons to be explained. The other end of the member 61 carries a rectangular, transversely extending flange 66. Above the flange 66 and substantially aligned with the member 61 is a rectangular wall 67 having a length substantially less than that of the flange 66.

A rectangular transversely extending actuator or tab 70 is located on top of the wall 67. The upper surface 71 of the tab 70 is partly roughened or ridged to facilitate being gripped by one's thumb. The under surface 72 of the tab 70 has a smooth rear portion and a plurality of transversely extending ridges 73 on the front half. Each ridge and the space between ridges is substantially triangular in transverse cross section. The rear of the wall 67 defines a rear limit surface 74. Protruding laterally on each side of the wall 67 is a lug 75. The vertical front surface of each of the lugs 75 defines a front limit surface 76.

Figure 6:
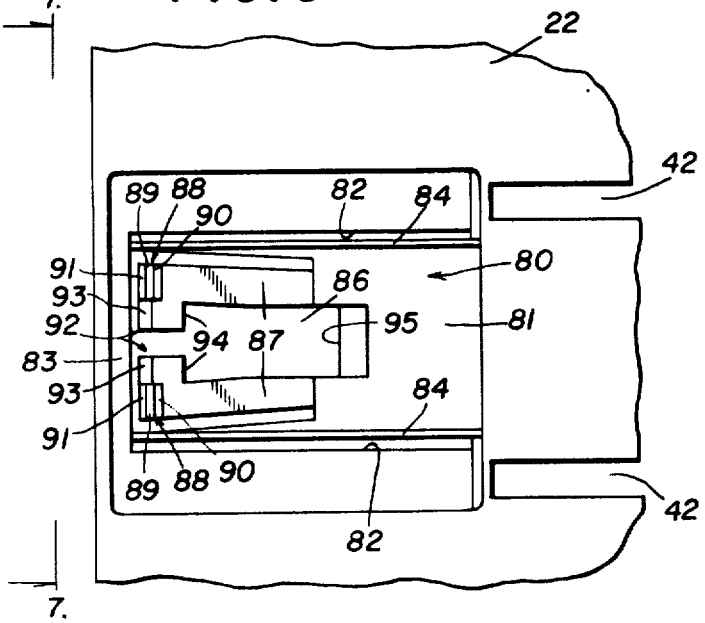
FIG. 6 is a fragmentary top plan view of a portion of the head taken along the line 6—6 of FIG. 5.
Figure 7:
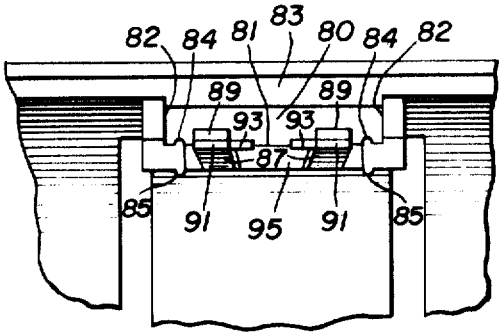
FIG. 7 is a fragmentary front elevational view of the top portion of the head taken along the line 7—7 of FIG. 6.

Referring to FIGS. 5, 6 and 7, there is formed in the top wall 22 of the head 20 a recess 80 having a floor 81 and side walls 82. The front of the top wall 22 is uninterrupted and defines an arm 83. The floor 81 has a pair of laterally spaced-apart upper ribs 84 extending front to back and being located respectively closely adjacent the side walls 82. Similarly, the undersurface of the floor 81 has a pair of ribs 85 which are vertically aligned with the ribs 84. The floor 81 is cut out at 86 in which cut out is located a pair of laterally spaced-apart forwardly directed fingers 87 that are bent and biased upwardly. The forward end of each finger 87 carries an upwardly directed detent 88. Referring to FIG. 6, the detent has surfaces 89 and 90 at the same inclination as the ridges 73 in the tab 70. In an operative embodiment the inclination was 45°. The front of each finger 87 is inclined to provide a camming surface 91 which is continuation of the surface 89. To shorten the finger slightly, the surface 91 has a different inclination, such as 60°.

The tab 70 rests on the ribs 84 which provide line contact to reduce friction that would occur between the tab 70 and the floor 81. Similarly, the flange 66 engages the ribs 85 which provides line contact to minimize friction. The detent engages in the space between a pair of ridges 73 to cause the carriage 60 to stay at a selected position until positive actuation. The tab 70 and the flange 66 effectively sandwich the floor 81 therebetween. Such construction minimizes deviation of the carriage 60 from the vertical orientation depicted. The tendency of the carriage 60 to rotate in any direction is therefore minimized.

Because the socket 50 is connected by wires 54 to the interior of the housing 15, the head can be oriented as desired and as is explained in greater detail in the above-mentioned copending application. This construction enables adjustment of the beam width without sacrificing its orientation capability.

Each finger 87 carries near the forward end thereof an inwardly directed lug 92, the lugs 92 being laterally aligned. The front of each of the lugs 92 is inclined to provide a camming surface 93. The rear of each lug 92 defines a substantially vertical front limit surface 94. The rear end of the cut out 86 is also substantially vertical and defines a rear limit surface 95. The bottom wall 23 of the head 20 carries a pair of spaced-apart rails 97 (FIG. 5), the distance between the rails 97 being slightly greater than the thickness of the member 61. The carriage 60 is positioned in the head 20 such that the end 63 is located between the rails 97 and the tab 70 is located in the recess 80.

In initial assembly, the tab 70 is inserted into the recess 80, the lugs 75 being respectively aligned with the lugs 92. As the tab 70 is urged rearwardly, the camming surfaces 93 respectively engage the lugs 75 causing the fingers 87 to deflect downwardly. The tab 70 can be moved further rearwardly until the lugs 92 clear the lugs 75 at which time the lugs 92 snap up against the surface 72, the detents 88 respectively entering into the space between the first pair of ridges 73. As the tab 70 is moved rearwardly, the ridges 73 deflect the fingers 87 downwardly so as to disengage the detents 88. In this manner, the tab 70 may be moved to any desired position. After assembly of the carriage 60 into the head 20, the carriage 60 is not readily removed without inserting an instrument to manually deflect the fingers 87.

Figure 4:
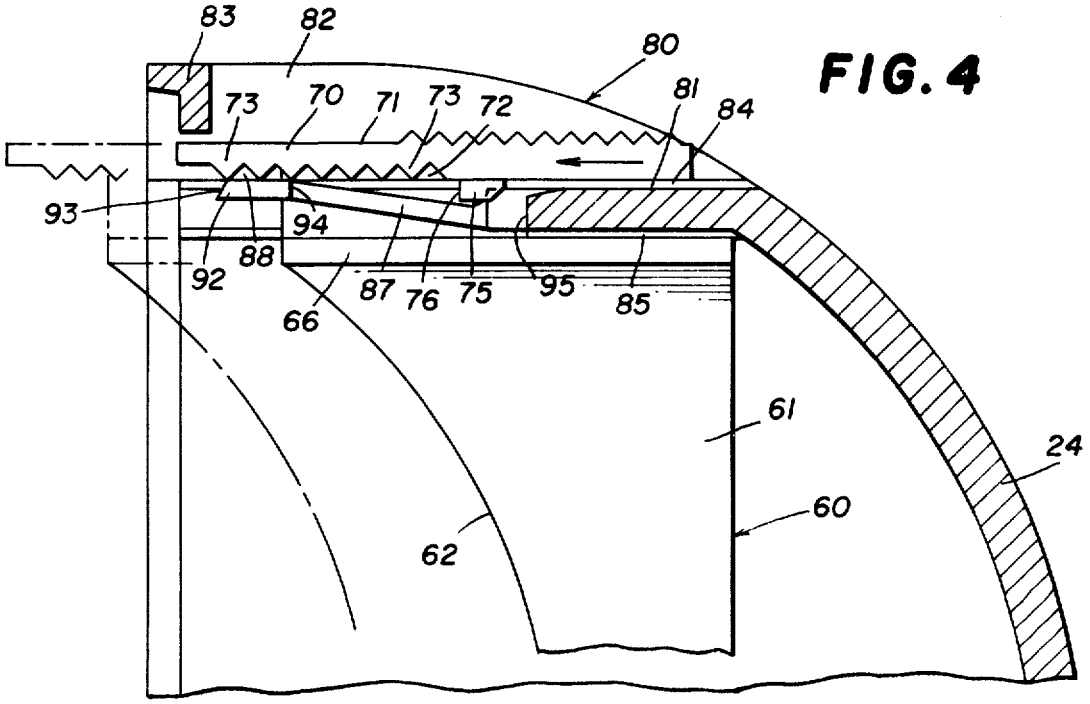
FIG. 4 is a view in vertical section on an enlarged scale taken along the line 4—4 of FIG. 3.

The forwardmost position of the carriage 60 as shown in phantom in FIG. 4, is attained when the limit surface 76 engages the limit surface 94. The rearmost position of the carriage 60 is attained when the limit surface 74 strikes the limit surface 95, as shown by the solid line in FIG. 4. The cutout 64 in the lower end of the member 61 enables clearance of the lower end of the curved rear wall 24 of the head 20.

It will be noted in FIG. 2 that the tab 70 is located directly in front of the on-off switch 17. One holding the flashlight 10 by having his fingers encircling the handle 16 can use his thumb to operate the switch 17 for turning the flashlight on and off and to move the tab 70 forwardly and rearwardly using the same thumb. Moving the tab 70 rearwardly moves the bulb 51 (FIG. 5) rearwardly, its rearmost position being at the focus of the reflector 34. At that point the beam generated by the flashlight 10 is concentrated and its diameter is theoretically constant. Movement of the tab 70 forwardly moves the light bulb 51 forwardly and away from the reflector focus. The light beam is thereby caused to spread, increasing the illumination area. When the tab 70 is in its forwardmost position, the size of the illumination area is maximized.

What has been described therefore is an improved hand-held light which has means to vary the beam width. The light can also be designed to have a rotatable head in conjunction with the beam width feature. Even with these features, the light is economical to manufacture. While a flashlight has been specifically described, the present invention is applicable to other hand-held lights.

We claim:

1. A battery operated flashlight comprising a housing portion for the battery, a separate head portion connected to said housing and having at least one wall, spaced-apart support members on said one wall, a carriage, support structure on said carriage extending between and slidably engageable with said support members for supporting said carriage for sliding movement between first and second extremes, a socket on said carriage for holding a bulb, and means on said carriage accessible on the exterior of said head portion for being engaged by one's finger to move said carriage to a selected position between said first and second extremes.

2. The flashlight of claim 1, and further comprising wires connecting said socket to the battery.

3. A battery operated flashlight comprising a housing portion for the battery and having a front end and a rear end, a handle integral with said housing and extending generally between the front and rear ends thereof, an on-off switch in said handle for operation by one's thumb, a separate head portion connected to said housing portion at the front thereof and having at least one wall, spaced-apart support members on said one wall, a carriage, support structure on said carriage extending between and slidably engageable with said support members for supporting said carriage for sliding movement between rear and front extremes, and a socket on said carriage for holding a bulb, said carriage including an actuator protruding through said upper wall for being engaged by one's thumb to move said carriage to a selected position between said rear and front extremes.

4. The flashlight of claim 3, and further comprising wires connecting said socket to the battery.

5. The flashlight of claim 3, wherein said carriage includes an elongated plate-like member oriented parallel to the direction of movement thereof, said head portion including a further wall carrying a pair of rails receiving said carriage.

6. The flashlight of claim 3, and further comprising means for limiting the extent of movement of said carriage.

7. A battery operated flashlight comprising a housing for the battery and having a front end and a rear end, a handle integral with said housing and extending generally between the front and rear ends thereof, an on-off switch in said handle for operation by one's thumb, a head carried by said housing at the front thereof and having upper and lower walls, a carriage slidably mounted on said walls and slidable between rear and front extremes, a socket for holding a flashlight bulb and being carried by said carriage, an arm above said upper wall, said carriage including a tab disposed between said arm and said upper wall being slidable forwardly and rearwardly, said tab having an upper surface to be gripped by one's thumb, said tab having a lower surface with ridges extending thereacross, a finger integral with said head and being biased upwardly against said lower surface and carrying a detent which springingly enters the space between adjacent ridges corresponding to a selected position of said tab.

8. The flashlight of claim 7, wherein said upper wall includes a recess therein having a floor and side walls, said arm spanning said recess and said tab being located in said recess beneath said arm.

9. The flashlight of claim 8, wherein the front portion of said floor is cut away, said finger being a continuation of said bottom wall and being located in said cut-away portion.

10. The flashlight of claim 7, and further comprising a second finger integral with said head and being biased upwardly against said lower surface and carrying a second detent which springingly enters the space between the same ridges corresponding to the selected position of said tab.

11. The flashlight of claim 7, wherein said upper wall includes a recess therein having a floor and side walls, said arm spanning said recess and said tab being located in said recess beneath said arm, the front portion of said floor being cut away, said finger being a continuation of said bottom wall and being located in said cut-away portion, and further comprising a second finger integral with said head and being biased upwardly against said lower surface and carrying a second detent which springingly enters the space between the same ridges corresponding to the selected position of said tab.

12. The flashlight of claim 7, and further comprising a pair of upstanding rails on said lower wall aligned with said arm, said carriage including an elongated plate-like member having first and second ends, said tab being integral with said member at said first end, said second end being slidably movable between said rails.

13. The flashlight of claim 7, and further comprising wires connecting said socket to the battery.

14. The flashlight of claim 7, and further comprising means for limiting the extent of movement of said carriage.

15. The flashlight of claim 7, wherein said actuator is located directly in front of said on-off switch.

16. The flashlight of claim 7, wherein said carriage includes an elongated plate-like member, and a flange integral with said plate-like member and disposed generally parallel to said tab and being located beneath said upper wall.

17. The flashlight of claim 16, wherein said carriage includes an elongated plate-like member oriented parallel to the direction of movement thereof, and a wall between said tab and said flange said aligned with said plate-like member.

18. The flashlight of claim 17, wherein said upper wall includes a recess therein having a floor and side walls, said arm spanning said recess, said tab being located in said recess beneath said arm, the front portion of said floor being cut away, said finger being a continuation of said bottom wall and being located in said cut-away portion, the rear of said wall defining a first limit surface and the rear of said cut-away portion defining a second limit surface, said limit surfaces engaging to limit the extent of rearward movement of said carriage.

19. The flashlight of claim 17, wherein said upper wall includes a recess therein having a floor and side walls, said arm spanning said recess, said tab being located in said recess beneath said arm, the front portion of said floor being cut away, said finger being a continuation of said bottom wall and being located in said cut-away portion, and further comprising a second finger integral with said head and being biased upwardly against said lower surface and carrying a second detent which springingly enters the space between the same ridges corresponding to the selected position of said tab, said wall being located between said fingers, said wall carrying a pair of oppositely directed lugs each having a first limit surface, said fingers respectively having inwardly directed lugs, each having a second limit surface, said limit surfaces engaging to limit the extent of forward movement of said carriage.

20. A hand-held light comprising a head having upper and lower walls, a carriage slidably mounted on said walls and slidable between rear and front extremes, a socket for holding a flashlight bulb and being carried by said carriage, an arm above said upper wall, said carriage including a tab disposed between said arm and said upper wall being slidable forwardly and rearwardly, said tab having an upper surface to be gripped by one's thumb, said tab having a lower surface with ridges extending thereacross, a finger integral with said head and being biased upwardly against said lower surface and carrying a detent which springingly enters the space between adjacent ridges corrresponding to a selected position of said tab.

* * * * *